US009236668B2

(12) United States Patent
Yeh

(10) Patent No.: US 9,236,668 B2
(45) Date of Patent: Jan. 12, 2016

(54) LOW PROFILE CABLE CONNECTOR

(71) Applicant: HON HAI PRECISION INDUSTRY CO., LTD., New Taipei (TW)

(72) Inventor: Cheng-Chi Yeh, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/487,095

(22) Filed: Sep. 16, 2014

(65) Prior Publication Data

US 2015/0087179 A1 Mar. 26, 2015

(30) Foreign Application Priority Data

Sep. 23, 2013 (TW) ..... 102217733 U

(51) Int. Cl.
*H01R 9/05* (2006.01)
*H01R 4/50* (2006.01)

(52) U.S. Cl.
CPC ..... *H01R 4/5083* (2013.01); *H01R 9/05* (2013.01)

(58) Field of Classification Search
CPC ..... H01R 17/12; H01R 13/53
USPC ..... 439/578, 585, 668–669, 79, 63, 934, 439/388
See application file for complete search history.

(56) References Cited

U.S. PATENT DOCUMENTS

| | | | | |
|---|---|---|---|---|
| 7,025,631 | B2 | 4/2006 | Yamane | |
| 7,118,383 | B2 * | 10/2006 | Nagata et al. | 439/63 |
| 8,096,828 | B2 * | 1/2012 | Ellis et al. | 439/578 |
| 8,419,463 | B2 * | 4/2013 | Taguchi | 439/449 |
| 2005/0136700 | A1 * | 6/2005 | Ikeda | 439/63 |
| 2006/0024985 | A1 * | 2/2006 | Nagata et al. | 439/63 |

* cited by examiner

*Primary Examiner* — Phuongchi Nguyen
(74) *Attorney, Agent, or Firm* — Wei Te Chung; Ming Chieh Chang

(57) ABSTRACT

A cable connector for connecting a cable having an inner conductor includes an insulating housing having an assembling portion and a mating portion protruding from one side of the assembling portion, the mating portion including a mating cavity, the assembling portion including a receiving room communicating with the mating cavity; a contact having a connecting portion received in the receiving room for connecting the inner conductor of the cable and a contacting portion extending into the mating cavity; and a shell having a back portion assembled upon the assembling portion of the insulating housing. The insulating housing includes an elastic arm extending into the receiving room and located beside the connecting portion of the contact. The back portion of the shell includes a pushing portion pushing the elastic arm to press the connecting portion of the contact.

14 Claims, 8 Drawing Sheets

LOW PROFILE CABLE CONNECTOR

BACKGROUND OF THE INVENTION

1. Field of the Invention

The present disclosure relates to a cable connector, and more particularly to an L-shaped coaxial cable connector.

2. Description of Related Art

Coaxial cable connectors are widely used in notebook, mobile phone and other electronic devices for connecting a coaxial cable with a printed circuit board. U.S. Pat. No. 7,025,631 issued to Yamane on Apr. 11, 2006 discloses a coaxial cable connector. The coaxial cable connector comprises an insulating housing, a contact retained in the insulating housing, a shell surrounding the insulating housing and a coaxial cable connecting the contact and extending out of the insulating housing. The insulating housing comprises a tubular portion and a lid extending upwardly from the tubular portion. The contact comprises a flat soldering portion for soldering the coaxial cable thereon. The shell comprises a cover extending upwardly for covering the insulating housing and retaining the coaxial cable. When the cover is bent towards the insulating housing, the cover pushes the lid and presses the coaxial cable on the soldering portion. However, as the coaxial cable is sandwiched by the lid and the soldering portion of the contact, the height of the coaxial cable connector is high and can not meet the miniaturization tendency. Another aspect, as the coaxial cable is put on the flat soldering portion and capable of moving freely before fixing, the connection quality between the coaxial cable and the contact can not be ensured.

In view of the above, an improved cable connector is desired to overcome the problems mentioned above.

SUMMARY OF THE INVENTION

Accordingly, an object of the present disclosure is to provide a low profile cable connector.

According to one aspect of the present disclosure, a cable connector with a contact clipping a cable horizontally is provides. The cable connector includes an insulating housing having an assembling portion and a mating portion protruding from one side of the assembling portion, the mating portion including a mating cavity, the assembling portion including a receiving room communicating with the mating cavity; a contact having a connecting portion received in the receiving room for connecting the inner conductor of the cable and a contacting portion extending into the mating cavity; and a shell having a back portion assembled upon the assembling portion of the insulating housing. The insulating housing includes an elastic arm extending into the receiving room and located beside the connecting portion of the contact. The back portion of the shell includes a pushing portion pushing the elastic arm to press the connecting portion of the contact.

Other objects, advantages and novel features of the disclosure will become more apparent from the following detailed description when taken in conjunction with the accompanying drawings, in which:

DETAILED DESCRIPTION OF THE INVENTION

Figure 1:
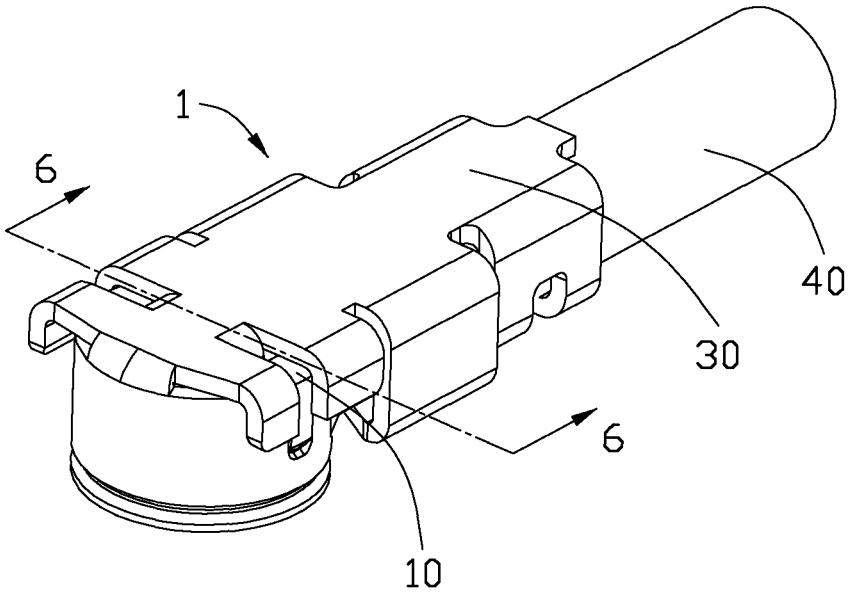
FIG. 1 is an assembled, perspective view of a cable connector in accordance with a first embodiment of the present disclosure.
Figure 2:
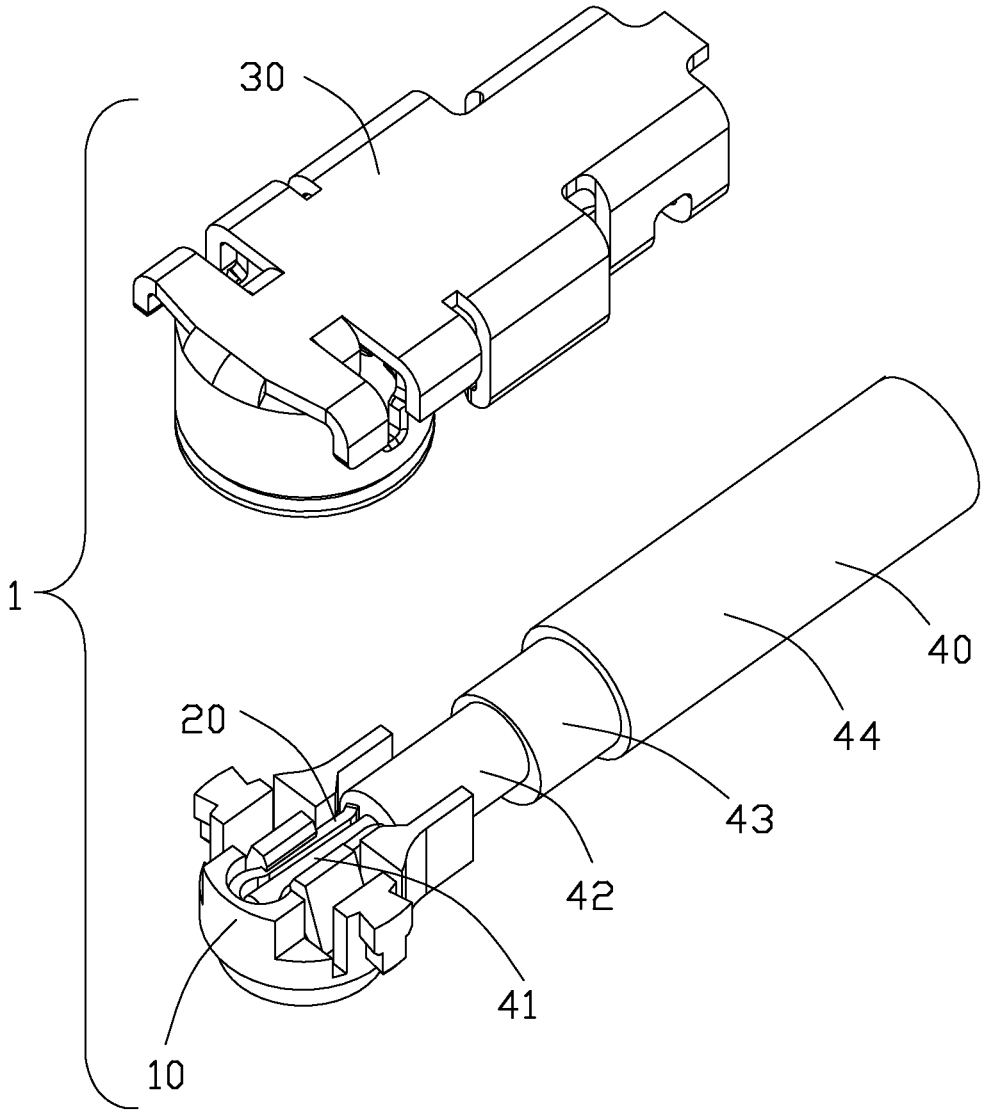
FIG. 2 is an exploded, schematic view of the cable connector shown in FIG. 1.
Figure 3:
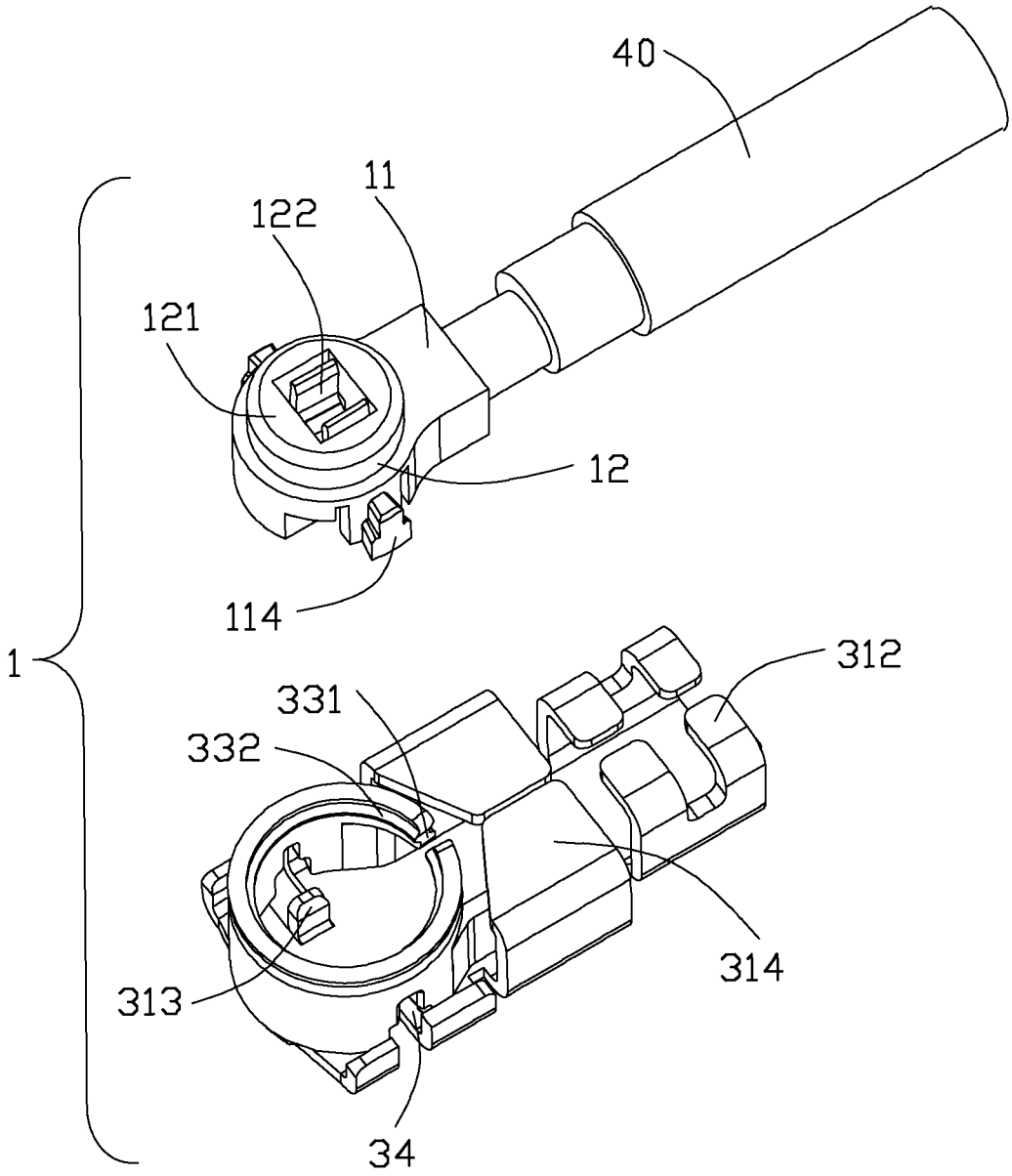
FIG. 3 is another view of the cable connector shown in FIG. 1.
Figure 4:
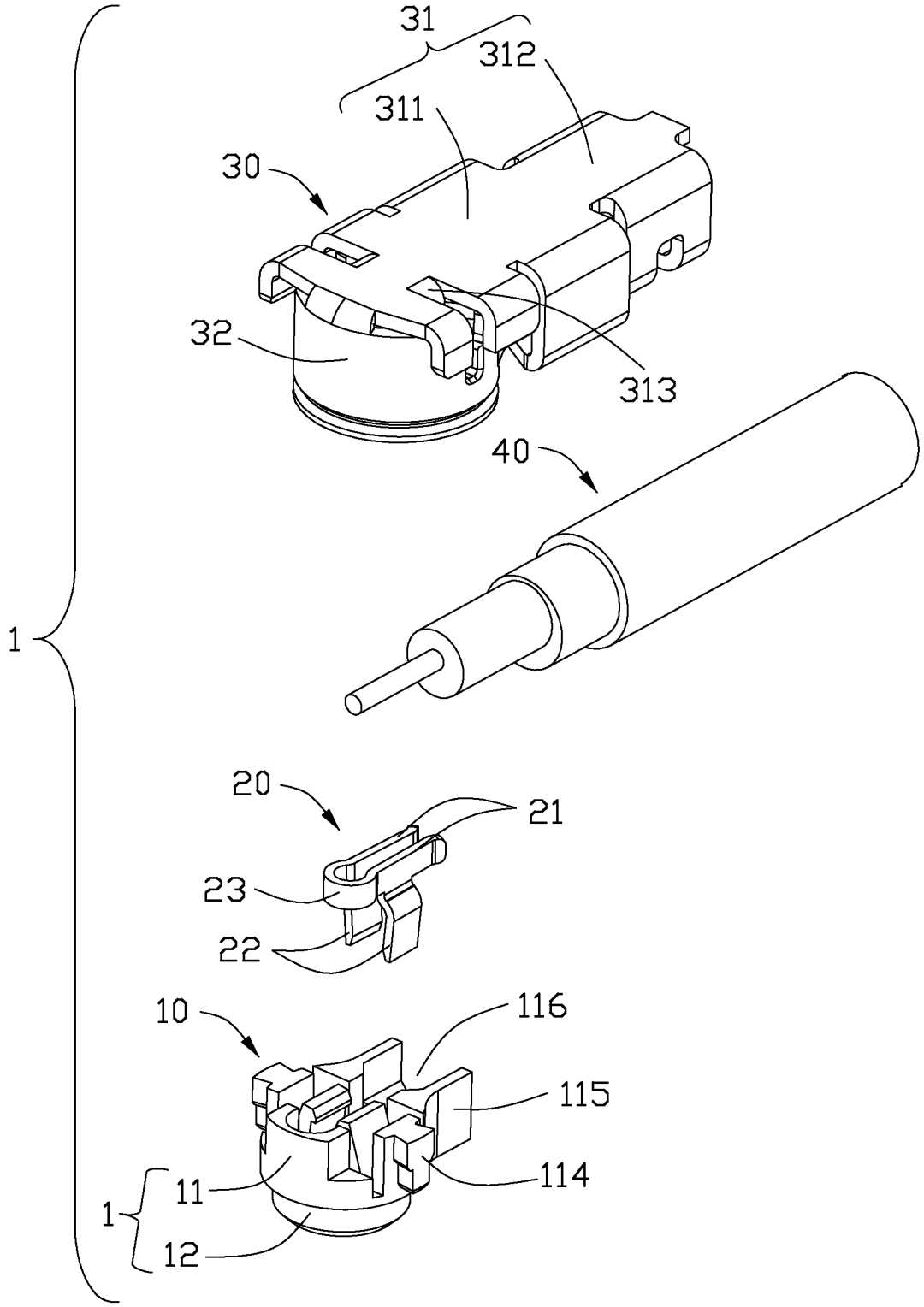
FIG. 4 is an exploded, perspective view of the cable connector shown in FIG. 1.
Figure 5:
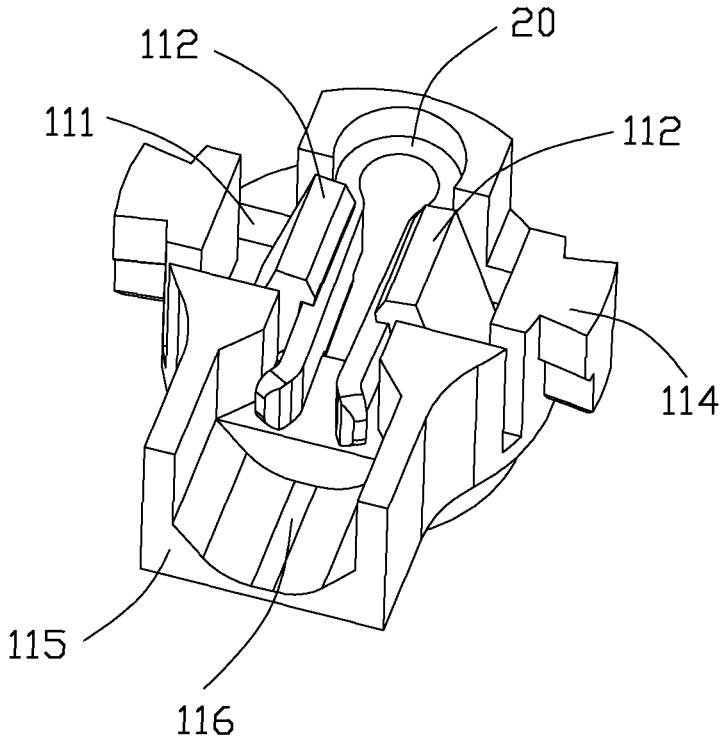
FIG. 5 is an assembled, perspective of an insulating housing and a contact shown in FIG. 4.

Reference will now be made to the drawings to describe a preferred embodiment of the present disclosure in detail.

Referring to FIGS. 1 to 6, an cable connector 1 in accordance with a first embodiment of the present disclosure comprises an insulating housing 10, a contact 20 retained in the insulating housing 10, a shell surrounding the insulating housing 10 and a cable 40 connecting the contact 20 and extending out of the insulating housing 10. The cable 40 from the inside to the outside comprises an inner conductor 41, a dielectric layer 42 surrounding the inner conductor 41, an outer conductor 43 surrounding the dielectric layer 42 and a dielectric jacket 44 coating the outer conductor 43.

Referring to FIGS. 3 to 6, the insulating housing 10 comprises an assembling portion 11 and a tubular mating portion 12 protruding from the assembling portion 11. The mating portion 12 comprises mating surface 121 and a mating cavity 122 going through the mating surface 121. The assembling portion 11 comprises a receiving room 111 communicating with the mating cavity 122 and a pair of elastic arms 112 obliquely extending into the receiving room 111 in a face-to-face manner. Each of the elastic arms 112 defines an inserting room 113 with an inner surface of the receiving room 111. The elastic arm 112 comprises a hook portion 117 at a free end for retaining the contact 20. In this embodiment, the assembling portion 11 further comprises a pair of T-shaped protrusions 114 extending opposite to each other and a supporting portion 115 extending along a radial direction of the tubular mating portion 12 for supporting the cable 40. The supporting portion 115 defines a passageway 116 communicating with the receiving room 111 for accommodating the cable 40.

The contact 20 a pair of connecting portions 21 located in the receiving room 111, a pair of contacting portions 22 extending from the connecting portions 21 downwardly into the mating cavity 122, and an arc-shaped portion 23 linking said a pair of connecting portions 21 at one end. When assembling the contact 20 into the insulating housing 10 in an up-to-down direction, the contact 20 locates between said a pair of elastic arms 112, the contacting portions 21 extends into the mating cavity 122, the connecting portions 22 are locked by hooks 117 of the elastic arms 112 so as to be retained thereon.

The shell 30 comprises a back portion 31 covering the assembling portion 11 of the insulating housing 10 and a tubular trunk portion 32 surrounding the mating portion 12 of the insulating housing 10. The trunk portion 32 defines a cylindrical space 33. The trunk portion 32 comprises a pair of T-shaped cutouts 34 for matching with the T-shaped protrusions 114 of the insulating housing 10. The back portion 31 comprises a cover section 311 connecting the trunk portion 32 and a holding section 312. The cover section 311 comprises a pair of pushing portions 313 for pushing the elastic arms 112 of the insulating housing 10 and a pair of retention tabs 314 located around the supporting portion 115. The holding section 312 defines a plurality of wings for retaining the cable 40 tightly. In this embodiment, the trunk portion 32 defines a slot 331 for elastically deformation and a ring 332 for engaging a corresponding connector.

Figure 6:
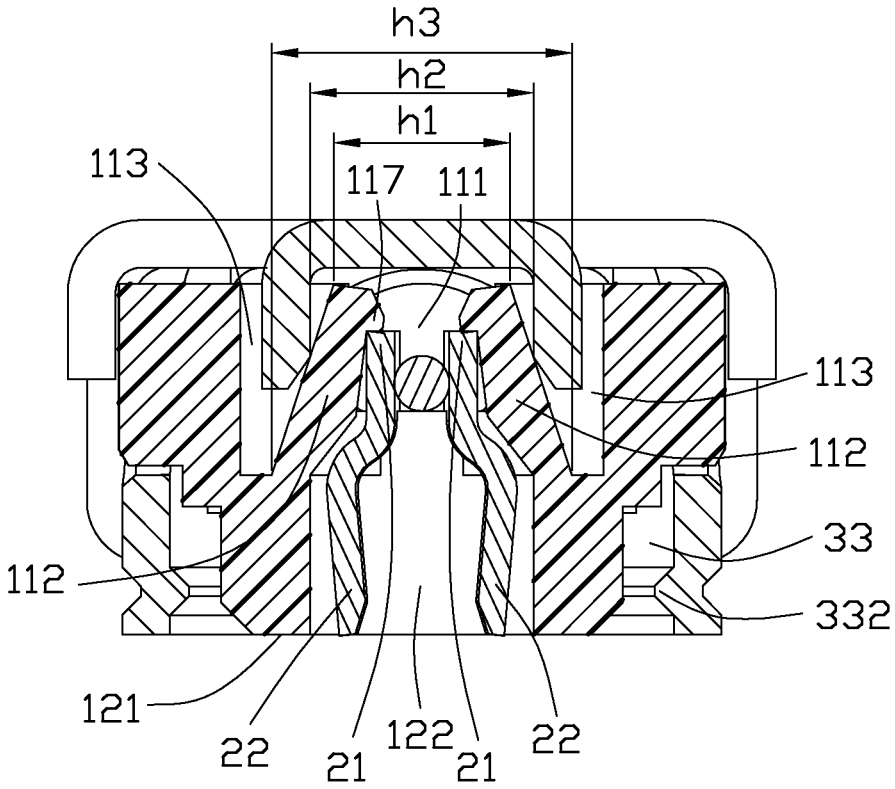
FIG. 6 is a cross sectional view along line 6-6 shown in FIG. 1.

Referring to FIG. 6, when assembling the insulating housing 10 into the shell 30, firstly, the mating portion 12 of the insulating housing is inserted into the trunk portion 32 of the shell 30, the T-shaped protrusion 114 matches with the T-shaped cutout 34. Then, the back portion 31 is bent towards the insulating housing 10, the pushing portions 313 are received in the inserting room 113 and push the elastic arms 112 to move towards the contact 20, the elastic arms 112 push the connecting portions 22 to clip the inner conductor 41 of the cable 40 tightly. As the elastic arms 112 are defined obliquely in a face-to-face manner, the distance h1 between two outer sides of the two elastic arms free ends is less than the distance h2 between two inner sides of the two pushing portions 313 while the distance h2 is less than the distance h3 between two outer sides of the other ends of the elastic arms. In the present disclosure, the inner conductor 41 of the cable 40 is clipped by the contact 20 horizontally before the shell 30 is bent, a stable connection between the contact 20 and the cable can be ensured. Another aspect, as no insulating lid between the shell and the contact is needed, the cable connector has a low profile.

Figure 7:
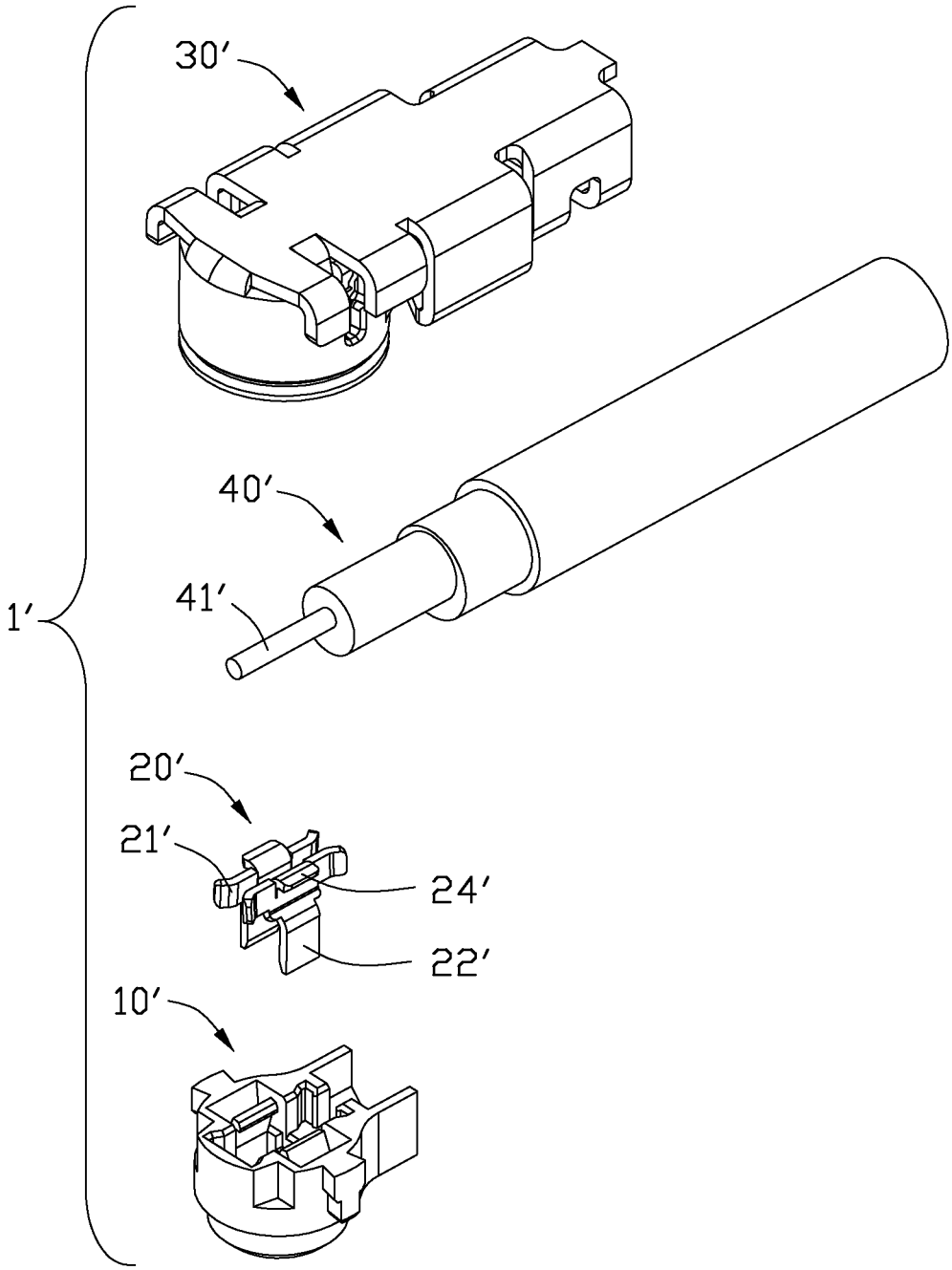
FIG. 7 is a schematic view of a cable connector in accordance with a second embodiment.
Figure 8:
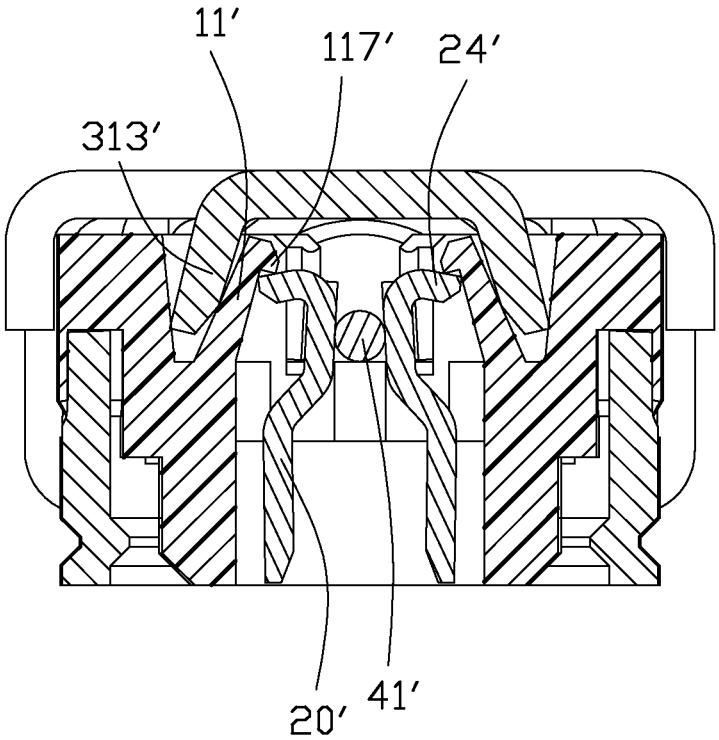
FIG. 8 is a cross sectional view of the cable connector shown in FIG. 7.

FIGS. 7 and 8 show a second embodiment of the present disclosure. An cable connector 1' comprises an insulating housing 10', a shell 30' and a cable 40' substantially the same with the first embodiment. The difference between the second and first embodiments is the structure of the contact. The contact 20' comprises two parts separated from each other. Each part comprises a connecting portion 21', a contacting portion 22' and a bending portion 24'. The bending portion 24' is locked by a hook 117' of an elastic arm 11'. A pushing portion 313' of the shell 30' pushes the elastic arm 11' urging the connecting portion 21' to clip an inner conductor 41' of the cable 40'. The structure of the separated type contact is easy. The separated type contact can be made from a contact carrier where the contact in the first embodiment has been manufactured and removed for cost down.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. A cable connector for connecting a cable having an inner conductor, comprising:

an insulating housing comprising an assembling portion and a mating portion protruding from one side of the assembling portion, the mating portion comprising a mating cavity, the assembling portion comprising a receiving room communicating with the mating cavity;

a contact comprising a connecting portion received in the receiving room for connecting the inner conductor of the cable and a contacting portion extending into the mating cavity; and a shell comprising a back portion assembled upon the assembling portion of the insulating housing; wherein the insulating housing comprises an elastic arm extending into the receiving room and located beside the connecting portion of the contact, the back portion of the shell comprises a pushing portion pushing the elastic arm to press the connecting portion of the contact; wherein the mating portion is tubular, the shell comprises a trunk portion extending from the back portion, and wherein the trunk portion surrounds the mating portion and defines a cylindrical space therebetween; wherein the contact comprises a pair of connecting portions while the insulating housing comprises a pair of elastic arms, and wherein said a pair of connecting portions locates between said a pair of elastic arms; wherein the assembling portion comprises a supporting portion extending in a radial direction of the mating portion, the supporting portion comprises a passageway for accommodating the cable, the back portion comprises a cover section defining a pair of retention tabs covering the supporting portion and a holding section defining a plurality of wings surrounding the cable.

2. The cable connector as claimed in claim 1, wherein an outer surface of the elastic arm is a tilted surface.

3. The cable connector as claimed in claim 1, wherein said a pair of connecting portions are connected by an arc-shaped portion.

4. The cable connector as claimed in claim 1, wherein said a pair of connecting portions are separated from each other, a bending portion extends from the connecting portion, the elastic arm locks the bending portion.

5. The cable connector as claimed in claim 1, wherein a free end of the elastic comprises a hook locking the connecting portion.

6. The cable connector as claimed in claim 5, wherein the trunk portion of the shell comprises a T-shaped cutout while the insulating housing comprises a T-shaped protrusion matching with the T-shaped cutout.

7. A cable connector comprising:

an insulating housing comprising a mating portion defining a mating cavity and an assembling portion defining a receiving room;

a contact comprising a pair of connecting portions received in the receiving room and a contacting portion extending into the mating cavity;

a cable comprising an inner conductor for connecting the connecting portion of the contact; and a shell comprising a back portion assembled upon the assembling portion of the insulating housing; wherein the insulating housing comprises a pair of elastic arms obliquely extending into the receiving room in a face-to-face manner with two free ends extending close to each other while the back portion comprises a pair of pushing portion extending into the receiving room, the distance between two inner sides of the two pushing portions is more than the distance between two outer sides of the two free ends but less than the distance between two outer sides of the other ends of the elastic arms opposite to the free ends; wherein in a horizontal direction, the inner conductor is clipped by a pair of connecting portions, said pair of connecting portions is clipped by a pair of elastic arms, and said pair of elastic arms is clipped by a pair of pushing portions.

8. The cable connector as claimed in claim 7, wherein the mating portion is tubular, the shell comprises a trunk portion extending from the back portion, and wherein the trunk portion surrounds the mating portion and defines a cylindrical space therebetween.

9. The cable connector as claimed in claim 8, wherein the assembling portion comprises a supporting portion extending in a radial direction of the mating portion, the supporting portion comprises a passageway for accommodating the cable, the back portion comprises a cover section defining a pair of retention tabs covering the supporting portion and a holding section defining a plurality of wings surrounding the cable.

10. The cable connector as claimed in claim 8, wherein said a pair of connecting portions are separated from each other, a bending portion extends from the connecting portion, the elastic arm locks the bending portion.

11. A connector assembly comprising:

an insulative housing defining a mating port extending along a first direction to communicate with an exterior via a front opening, and a connecting portion communicating with the first mating port and extending along a second direction perpendicular to said first direction;

a conductive contact defining a contacting section disposed in the mating port and a connecting section disposed in the connecting port; said contact being configured to be assembled into the housing via a rear face of the housing opposite to said front opening along the first direction; wherein the housing further includes unitarily a resilient locking arm, which is deflectable in a third direction perpendicular to said first direction to allow the contact to be initially assembled into the housing via said rear face along the first direction, and finally locked in position in the housing without backward moving; wherein said shell is assembled to the housing after the contact has been assembled into the housing, and said shell includes an arm abutting against the resilient locking arm so as to prevent deflection of the resilient locking arm for assuring locking the contact in position further including a cable having an inner conductor gripped by the connecting section which is gripped by the resilient locking arm in turn in said third direction.

12. The connector assembly as claimed in claim 11, wherein the third direction is perpendicular to the second direction.

13. The connector assembly as claimed in claim 11, further including a metallic shell enclosing the housing to veil the contact on the rear face.

14. The connector assembly as claimed in claim 11, wherein said shell is assembled to the housing after the contact has been assembled into the housing, and said shell includes an arm abutting against the resilient locking arm so as to prevent deflection of the resilient locking arm for assuring locking the contact in position, and said arm grips the resilient locking arm in the third direction.

* * * * *